US011340040B1

(12) United States Patent
Schuster

(10) Patent No.: US 11,340,040 B1
(45) Date of Patent: May 24, 2022

(54) INTEGRATED RECOIL REDUCTION APPARATUS

(71) Applicant: Joseph Adam Schuster, Emlenton, PA (US)

(72) Inventor: Joseph Adam Schuster, Emlenton, PA (US)

( * ) Notice: Subject to any disclaimer, the term of this patent is extended or adjusted under 35 U.S.C. 154(b) by 0 days.

(21) Appl. No.: 17/194,238

(22) Filed: Mar. 6, 2021

Related U.S. Application Data

(60) Provisional application No. 62/988,883, filed on Mar. 12, 2020.

(51) Int. Cl.
*F41C 23/06* (2006.01)

(52) U.S. Cl.
CPC ..... *F41C 23/06* (2013.01)

(58) Field of Classification Search
CPC ..... F41C 23/06; F41A 3/84
See application file for complete search history.

(56) References Cited

U.S. PATENT DOCUMENTS

| | | | | |
|---|---|---|---|---|
| 910,276 | A | 1/1909 | Easdale | |
| 1,379,989 | A | 5/1921 | Johnson | |
| 2,779,249 | A * | 1/1957 | Saetter-Lassen | F41A 3/84 89/198 |
| 2,799,249 | A | 1/1957 | Saetter-Lassen | |
| 6,481,143 | B2 | 11/2002 | McCarthy | |
| 6,732,466 | B2 * | 5/2004 | Bentley | F41C 23/04 42/74 |
| 6,889,594 | B2 | 5/2005 | Ebersole, Jr. | |
| 7,992,337 | B2 * | 8/2011 | Ochoa | F41C 23/14 42/74 |
| 9,927,206 | B1 * | 3/2018 | Smith | F41C 23/06 |
| 2010/0071246 | A1 * | 3/2010 | Vesligai | F41C 23/04 42/75.03 |
| 2012/0260552 | A1 * | 10/2012 | Vesligaj | F41C 23/06 42/1.06 |
| 2016/0273873 | A1 * | 9/2016 | Spyche, Jr | F41C 23/06 |

OTHER PUBLICATIONS

Bgallaher77, "Calculating Recoil of a Rifle", YouTube link: https://www.youtube.com/watch?reload=9&v=5lzJGs_4LR8, published Dec. 31, 2011.

Hawks, Rifle Recoil Table, https://www.chuckhawks.com/recoil_table.htm.

WB Jones Spring Company, Guide to Measuring Compression Springs https://www.springsfast.com/.

* cited by examiner

*Primary Examiner* — Gabriel J. Klein
(74) *Attorney, Agent, or Firm* — Karen Tang-Wai Sutton

(57) ABSTRACT

A recoil mitigation apparatus formed into a stock of a rifle, featuring a removable spring housed inside a spring chamber formed inside a pair of coaxial, telescoping tubes that slideably compress the spring when energy from a rifle is generated and transmitted to the stock and thus to the apparatus. The spring compresses, absorbing the energy and thus reducing energy transmission to the user's shoulder against which the butt end of the stock is positioned. The spring chamber and spring are accessible by removing an end cap of the apparatus located at a butt end of the stock using screw fasteners fastened into preexisting holes formed in the end cap. The spring is centered inside the spring chamber by insertion over the spring mount attached to the end cap facing inwards towards the spring chamber.

9 Claims, 9 Drawing Sheets

RECOIL TABLE
BASED ON AN 8 POUND RIFLE WEIGHT

| CALIBER | ENERGY FOOT POUNDS |
|---|---|
| 0.233 | 2.180 |
| 0.243 | 6.342 |
| 0.250 | 8.096 |
| 0.270 | 10.843 |
| 0.300 | 15.262 |
| 0.338 | 35.550 |
| 0.375 | 38.852 |

FIG. 9

$$V_{GUN} = \frac{\text{BULLET WT(GRNS)} \bullet \text{VBULLET} + \text{WEIGHT OF POWDER} \bullet (4000\ \text{VELOCITY POWDER})}{\text{WT RIFLE x 7000}}$$

BULLET WEIGHT IN GRAMS

VBULLET = VELOCITY OF BULLETT

WEIGHT OF POWDER CHARGE IN GRAINS

CONSTANT 4000 VELOCITY OF POWDER

VGUN = VELOCITY OF GUN

WT RIFLE = WEIGHT OF RIFLE IN POUNDS (7000) = CONSTANT

RECOIL FORMULA $$\text{RECOIL FOOT Lbs} = \frac{\text{RIFLE WEIGHT IN POUNDS X VELOCITY OF GUN (VGUN) x 2}}{\text{2x 32.174 fisec}}$$

FIG. 10

INTEGRATED RECOIL REDUCTION APPARATUS

CROSS-REFERENCE TO RELATED APPLICATIONS

Reference is made to and priority claimed from U.S. provisional application No. 62/988,883 filed 12 Mar. 2020 whose disclosure is herein incorporated in its entirety by reference.

STATEMENT REGARDING FEDERALLY SPONSORED RESEARCH OR DEVELOPMENT

NA

NAMES OF THE PARTIES TO A JOINT RESEARCH AGREEMENT

NA

INCORPORATION BY REFERENCE OF MATERIAL SUBMITTED ON A COMPACT DISC OR AS A TEXT FILE VIA THE EFS WEB SYSTEM

NA

STATEMENT REGARDING PRIOR DISCLOSURES BY THE INVENTOR OR A JOINT INVENTOR

NA

BACKGROUND OF THE INVENTION

Field of the Invention

The present invention pertains to the field of projectile-firing devices. More particularly, the present invention relates to a spring-based recoil reduction apparatus integrated into a replacement or original equipment rifle stock, or other projectile-firing devices where recoil reduction is desired.

Background Art

All rifles are comprised of an action, barrel, and stock. The stock provides structural support for the action and barrel, and allows the user to aim and steady the rifle by the user stabilizing the terminal end of the stock, called the butt, against the user's shoulder. The action loads, fires and unloads a bullet-holding shell or cartridge into the barrel. To fire a bullet, the action loads a bullet-holding cartridge into the chamber at the base of the barrel. Pulling the trigger causes the firing pin to snap forward, striking the primer at the base of the cartridge case. A spark ignites the gunpowder, causing it to burn rapidly and creating an explosive expansion of gas, forcing the bullet out of the cartridge and through the barrel at a high velocity. The bullet exits the barrel at the muzzle end. The force of the gas expansion in the confined space of the cartridge is transmitted through the rifle, causing the muzzle to lift upwards momentarily as the force travels through the stock, jamming the butt into the user's shoulder. This transfer of force is called recoil. As bullet caliber increases, so does recoil, which decreases the user's comfort, accuracy, and rate of firing, since the lifting action of the muzzle requires repositioning and re-establishing aim.

What is needed is a recoil reduction apparatus integrated into a stock that comes in standard sizes and with an approximately same weight and feel as existing original equipment manufacturer (OEM) and after-market replacement stocks.

DISCLOSURE OF INVENTION

A recoil reduction apparatus integrated into a rifle stock, comprising an exterior housing formed as a tube having a first end and a second end, a forward stop at the first end and a rear stop at the second end, a rib formed on an inner wall of the housing having a slot, and an insert formed as a tube with an insert chamber and with a spring stop dividing the insert chamber so as to create a spring chamber portion. The insert is further formed with a rail formed on an outer wall of the insert sized and shaped to slideably mate with the slot of the rib. A spring mount is sized and shaped to slideably position inside the insert chamber, with a spring having a predetermined spring force seated onto the spring mount. The spring mount is attached to an end cap that is removably affixed to the rear stop of the housing. When positioned inside the insert chamber, the spring on the spring mount sits inside the spring chamber in an uncompressed position between the rear stop and the spring stop.

When the rifle is fired, the recoil force generated pushes the insert into the housing, compressing the spring and stopping the energy from being further transmitted through the stock and to a shoulder of the user.

BRIEF DESCRIPTION OF THE DRAWINGS

The features and advantages of the invention will become apparent from a consideration of the subsequent detailed description presented in connection with accompanying drawings, in which:

FIG. 9 is a recoil table for an 8 pound rifle, showing rifle caliber and corresponding recoil measured in foot pounds per foot of energy.

FIG. 10 provides background formulas used to calculate the recoil table in FIG. 9.

DRAWINGS LIST OF REFERENCE NUMERALS

Figure 1:
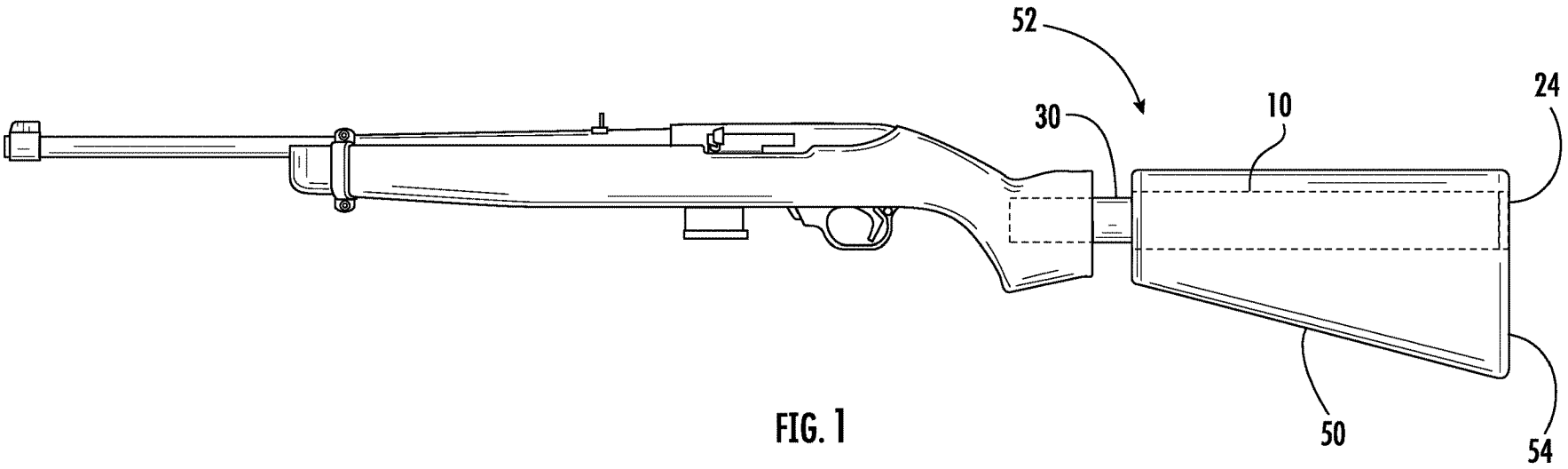
FIG. 1 is a side elevation view of a rifle whose stock is fitted with an integrated recoil reduction apparatus according to the invention.
Figure 2:
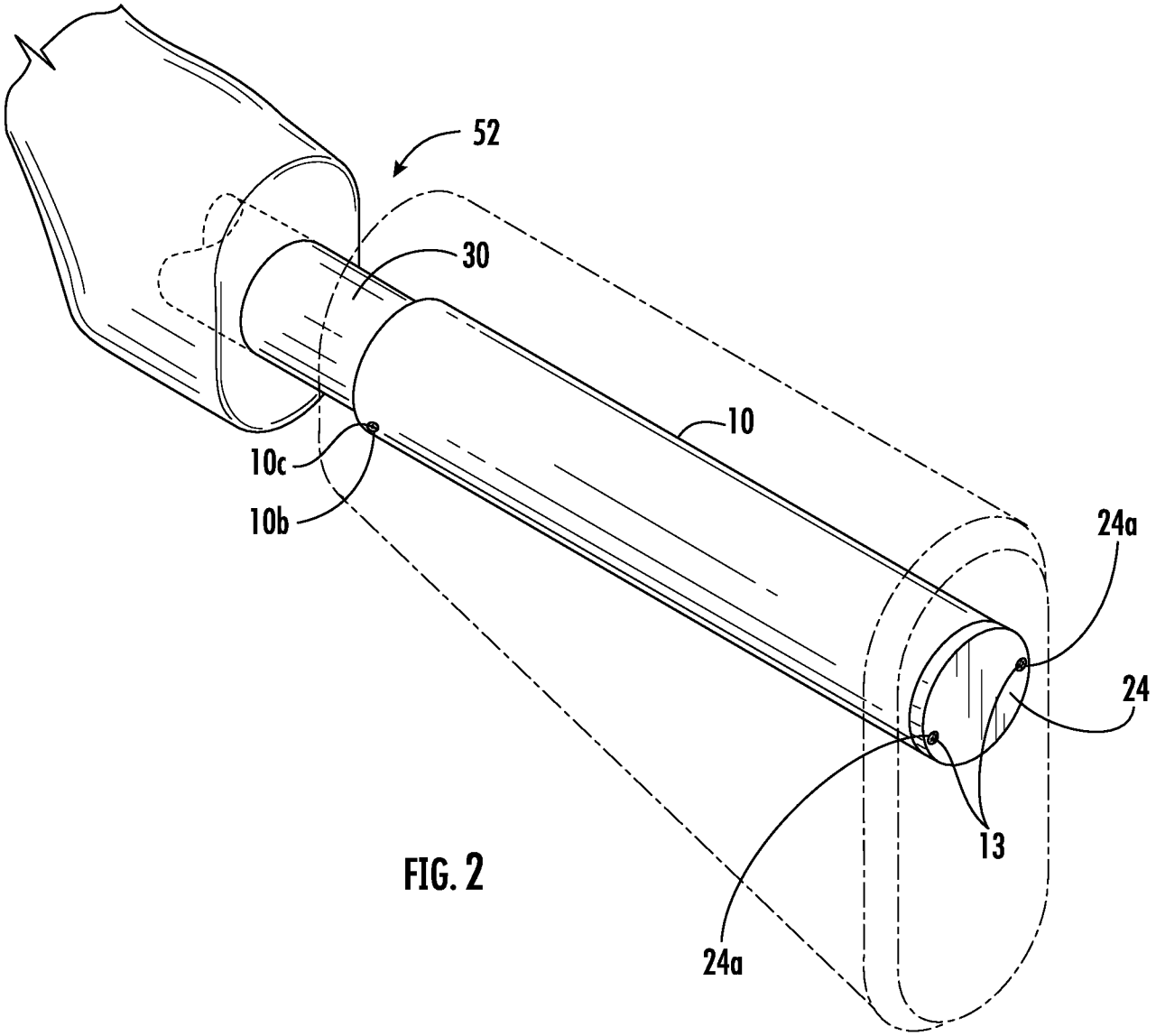
FIG. 2 is a perspective view of the integrated recoil reduction apparatus as it would appear inside the stock.

The following is a list of reference labels used in the drawings to label components of different embodiments of the invention, and the names of the indicated components.

100 recoil reduction apparatus or apparatus
10 outer tube or housing tube or housing
10*a* housing chamber
10*b* housing screw hole
10*c* housing screw
12 housing forward stop
12*a* hole in forward stop
13 screw fastener
14 housing rear stop
14*a* screw hole
16 channel or slot
18 ring or rib
20 stub or spring mount
22 spring
24 end cap (with screw holes)
24*a* end cap hole
30 insert tube
30*a* insert chamber
30*b* spring chamber
32 guide or rail
34 insert inner stop
36 proximal end of insert
38 distal end of insert
40 spring stop
42 user's shoulder
50 stock
52 barrel end of stock
54 butt end of stock

DETAILED DESCRIPTION

Figure 3:
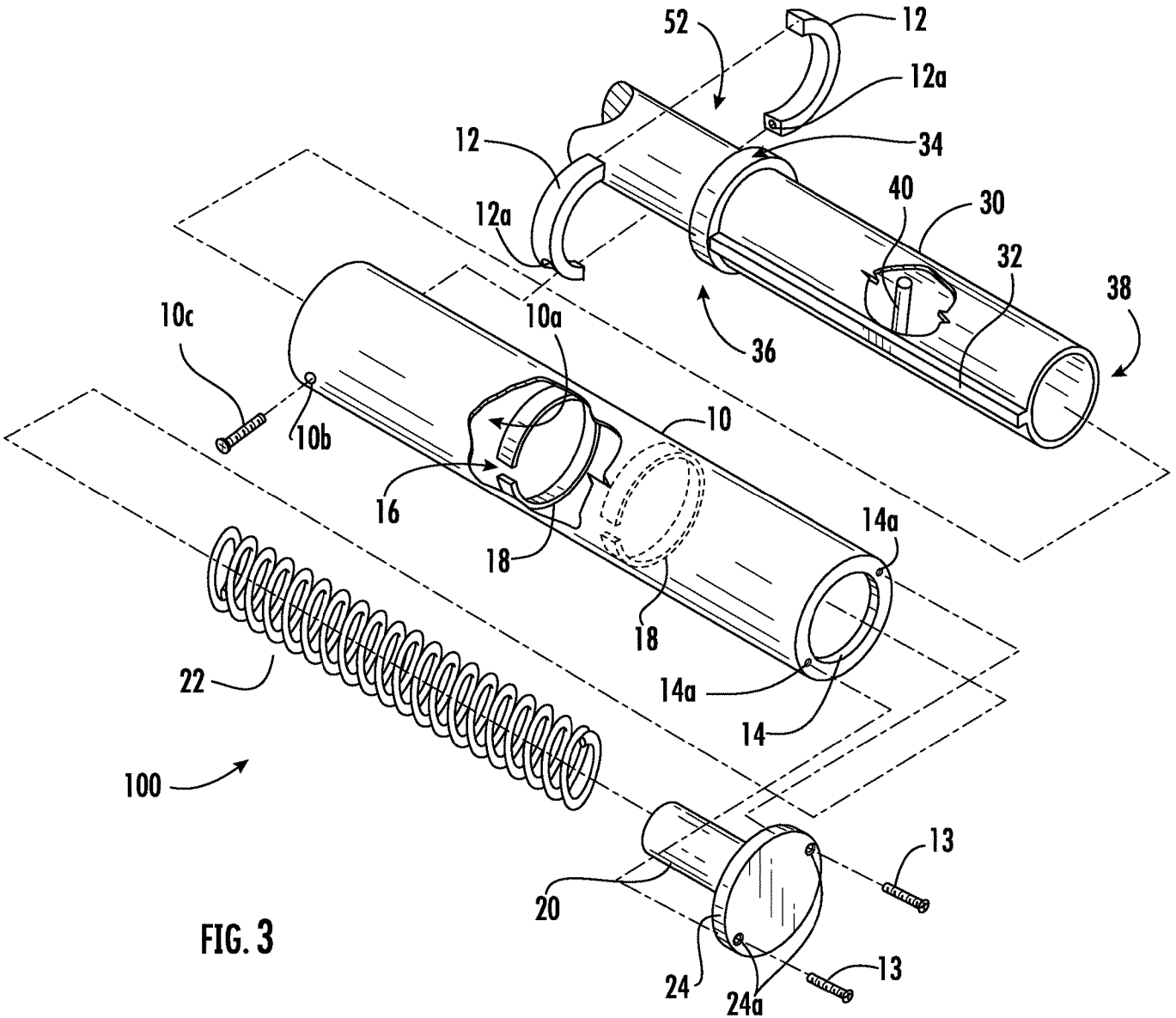
FIG. 3 is an exploded view of the integrated recoil reduction apparatus in FIG. 1.
Figure 4:
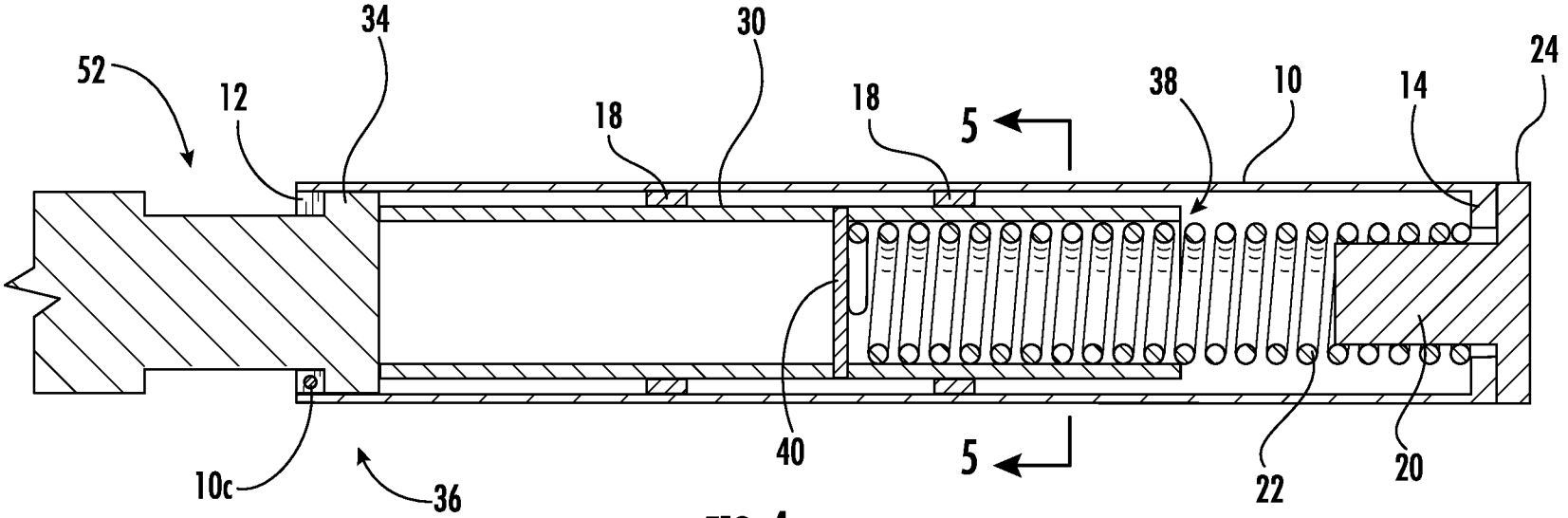
FIG. 4 is a side elevation, cross-sectional view of the integrated recoil reduction apparatus
Figure 5:
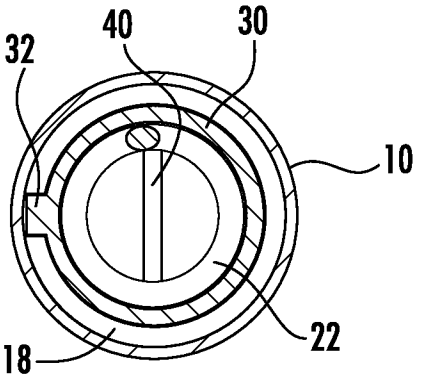
FIG. 5 is a cross section of the apparatus, taken along lines 5-5 in FIG. 4.

An integrated recoil reduction apparatus according to the invention or apparatus 100 is shown in FIGS. 1-9 in a representative embodiment. A recoil table showing recoil velocity and energy based on an 8 pound rifle weight is shown in FIG. 3, with formulas used for the table shown in FIG. 4.

Turning now to FIG. 1, the apparatus 100 is integrated into a stock 50 for a rifle, the stock 50 having a barrel end 52, approximately adjacent a receiver of the rifle, and a butt end 54 where the stock is positioned against a shoulder 42 of a user. The butt end 54 is often covered with a butt plate. The apparatus 100 is comprised of a pair of coaxial tubes, an outer tube or housing 10 having an internal housing chamber 10*a* and an inner tube or insert 30 slideably moving in and out of the housing chamber 10*a*.

The housing 10 is further comprised of a pair of stops at each end: a barrel or forward stop 12 formed typically as a bushing at the barrel end 52, and a rear stop 14 formed at the butt end 54 of the rifle. The forward stop 12 is further formed with two or more forward stop holes 12*a*, which align with two or more housing holes 10*b* formed into the housing 10 such that when the housing 10 is fitted over the forward stop 12, two or more screws 10*c* are positioned into the holes 10*b* 12*a*, affixing the housing 10 to the forward stop 12.

The rear stop 14 in the representative embodiment shown in the Figures is formed as a bushing with a pair of rear stop holes 14*a*. An inner wall of the housing chamber is further formed with a channel or slot 16, shown in the Figures as a notch or slot formed into a ring or rib 18 formed along the inner wall circumference of the housing chamber 10*a*. The Figures show a pair of parallel ribs 18 in spaced apart relationship and with the slot 16 of each rib 18 aligned so as to form a channel, however the inventor notes that the ribs 18 could also be configured as a single relatively wider rib 18 formed into the inner wall of the housing chamber 10*a* with a slot 16 cut therein, or as a plurality of spaced apart ribs 18 with their slots 16 aligned so as to create a channel. The inventor has chosen a pair of rings for his rib 18 design to reduce the housing chamber 10*a* internal circumference and minimize weight.

The insert 30 is a tube having an insert wall with a proximal end 36 and a distal end 38, with an insert wall having an insert wall length measured from proximal end to distal end. The insert wall has an exterior circumference sized to allow the insert 30 to slideably fit into the housing chamber 10*a* within the narrowed area created by the ribs 18. It is important that the insert 30 be sized to minimize extra space between its exterior circumference and the ribs 18 while still allow the insert 30 to telescope freely in and out of the housing chamber 10*a*. The insert wall is further comprised of an interior wall defining an insert chamber 30*a*. The insert chamber 30*a* is also formed with a pair of stops: an inner stop 34, formed on the proximal end 36 and a spring stop 40 positioned inside the insert chamber 30*a* so as to divide the insert chamber 30*a* into two parts: a forward portion located between the proximal end 36 and the spring stop 40, and a spring chamber 30*b* portion positioned between the spring stop 40 and the rear stop 14 of the housing chamber 10*a*. In the Figures, the spring stop 40 shown in the representative embodiment is a metal pin spanning a diameter of the insert chamber 30*a* and dividing it into the forward portion and the spring chamber 30*b*, however, the spring stop 40 could also be formed as a ring along a circumference of the inner chamber inner wall and sized to divide the insert chamber 30*a*. The inventor stresses that the pin design of the spring stop 40 is sized and shaped to divide the insert chamber 30*a* while minimizing material and weight. A length of the spring chamber 30*b* is thus comprised of that portion of the insert chamber 30*a* from the spring stop 40 to the distal end 38 of the insert 30 and continues to the rear stop 14 of the housing chamber 10*a* of the housing 10.

A guide or rail 32 is formed into the exterior wall of the insert 30 along the length of the insert wall such that the rail 32 is parallel to the insert chamber 30*a* length. The rail 32 is sized and shaped to slideably mate with the slots 16 in the housing chamber 10*a*, shown most clearly in FIGS. 1A and 2A. The rail 32 and slots 16 prevent the insert 30 from rotating as it slides in and out of the housing chamber 10*a*. As previously mentioned, the inventor notes that while the representative embodiment shown in the Figures of a single rail and a pair of spaced apart ribs each with a slot formed therein, there are many other suitable coupling configurations that can be substituted for what is shown in the Figures that allow a slideable coupling relationship between the housing 10 and the insert 30. The inventor notes the use of ribs 18 allows for a thinner and thus lighter housing 10 while still reliably guiding the forward-backwards sliding motion of the insert 30 as well as minimizing unwanted side-to-side, or up-and-down movement of the insert 30. The inventor notes that other rib variations include half or partial ribs, where a discontinuous rib having a top portion and a bottom portion are positioned on opposed sides of the housing chamber inner wall to support and guide the insert tube centrally within the housing 10 and further reduce weight or materials, as well as partial ribs positioned around the housing chamber circumference to reduce weight and maintain function.

A spring mount 20 formed as a protruding rod or shaft is attached at one end to an end cap 24. A spring 22 inserts over the spring mount 20 so as to position one end of the spring adjacent the end cap 24. The end cap 24 is further formed with a pair of screw holes 24*a* sized and shaped to receive a pair of screw fasteners 13, with the pair of end cap holes 24*a* positioned to align with the pair of rear stop holes 14*a*, such that when the spring mount 20 is positioned inside the insert chamber 30*a* and the housing chamber 10*a*, the end cap 24 is immediately adjacent the housing rear stop 14 and the user rotates the end cap 24 to align the respective holes 14*a* 24*a* and fasten the screw fasteners 13, where the end cap 24 covers the rear stop 14 of the housing 10 and is at the butt 54 of the stock 50, and may be formed as part of the butt plate. The end cap 24 and the fasteners 13 are positioned in the stock so as to be accessible by the user through the butt 54.

When the spring 22 is positioned inside the spring chamber 30*b*, the spring 22 is positioned first on the spring mount 20 with one end resting against the end cap 24, pushed inside the spring chamber 30*b*, where an opposed end of the spring is positioned adjacent to the spring stop 40, and the end cap 24 is fastened to the housing 10 and the rear stop 14 by fastening the fasteners 13 into the holes 14*a* 24*a*. The spring 22 at this point is in an uncompressed state, and the opposed end of the spring 22 may or may not be positioned immediately against the spring stop 40. The spring mount 20 ensures the spring 22 is positioned inside the spring chamber 30*b* so as to minimize or eliminate side-to-side and up-and-down motion of the spring 22. The inventor notes that while the spring 22 is sized to fit in an uncompressed state inside the spring chamber 30*b*, a relative length of the spring 22 may in fact be shorter than a length of the spring chamber 30*b* or have an outside diameter measurement that is relatively much smaller than that of the spring chamber 30*b*, characteristics that would allow the spring 22 to move around the spring chamber 30*b* inefficiently and that may affect its performance for recoil mitigation. The inventor notes that the length of the spring chamber 30*b* is determined at least in part by the length of the spring 22 in its uncompressed state, but the spring chamber 30*b* is itself shorter than the spring 22 in its uncompressed state, and thus the spring 22 in its uncompressed state sits partially inside the insert chamber and the rest sits in the housing chamber 10*a* portion of the spring chamber 30*a*. The inventor notes that the spring mount 20 is necessary because the housing chamber 10*a* portion of the spring chamber 30*b* is necessarily larger than the diameter of the insert portion of the spring chamber, and hence without the spring mount 20, the distal end 38 of the insert 30 may catch one or more coils of the spring 22 and cause unwanted movement of the spring during compression, rather than an efficient compression thereof.

Turning now to FIG. 9, the table shows various measures of ammunition caliber for an 8 pound rifle and the measured recoil energy shown in pounds/foot. Data populating this table was calculated using two formulas, one calculating velocity of gun (Vgun) and recoil, shown in FIG. 10. Formulas used in FIG. 4 were obtained from the prior art such as a YouTube video by bgallaher77 titled "Calculating Recoil of a Rifle" posted on YouTube on Dec. 31, 2011 at https://www.youtube.com/watch?reload=9&v=51zJGs_4LR8. The inventor notes that this video is one of many on the internet explaining how to calculate recoil. Further, recoil tables are well known in the rifle industry and among shooting enthusiasts. A well-known and often cited recoil table is found online at https://www.chuckhawks.com/recoil_table.htm and hence FIGS. 9 and 10 are based on well-established formulas and methods of measurement widely available and shared within the public domain. While physical characteristics of the user, including the stance used while firing the rifle, factor into perceived recoil, a caliber size, a diameter measurement of the bullet-containing cartridge, and rifle weight also directly influence recoil and perceived comfort/discomfort by the user.

Hence, in order to reduce recoil, an appropriate spring force must be selected according to the caliber ammunition used in the rifle. Referring to the Figures and the representative rifle, a 30-06 Springfield, originally made by Winchester for the US army in 1906 (and is a standardize rifle), shooting .30 caliber ammunition, is shown with the representative apparatus 100 having the following specifications:

Spring length: 6 inches
Spring coil number: 21
Spring outside diameter (OD): 1.125 inches
Spring inside diameter (ID): 1.015 inches
Space between coils: 0.055 inches
Spring Force: 14.5 foot pounds
Spring Material: steel
Housing length: 13 inches
Housing outside diameter (OD): 2 inches
Housing inside diameter (ID): 1.550 inches
Insert length: 8.750 inches
Insert outside diameter (OD): 1.510 inches
Insert inside diameter (ID): 1.400 inches
Rail length: 4 inches
Position of spring stop from distal end of insert: 3.750 inches When the inventor tested the representative rifle without the apparatus 100 installed in the stock 50, the recoil felt against his shoulder was 14.5 foot pounds, and muzzle lift, measured from an initial set position of the muzzle prior to firing, to a highest vertical lift point from the initial set position after firing, was 6.295 inches. Fitted with the apparatus 100, perceived recoil against his shoulder was perceptibly significantly diminished, while muzzle lift was eliminated by approximately 4 inches. The inventor notes that had he substituted a spring with a larger spring force, he could have further reduced or eliminated muzzle lift entirely and further reduced perceived recoil. The rifle shown in the Figures and its relevant characteristics are included here as a representative rifle to show the invention's relative recoil mitigation for a rifle of this specification.

Selection of the appropriately sized spring 22 for the apparatus 100 is determined by the material of the spring, its outer and inner dimensions, number of coils, width or space between coils, and an overall length when the spring is in its uncompressed state. Springs used by the inventor are sourced from WB Jones Spring Company of Wilder, Ky. at https://www.springsfast.com/, whose website provides excellent information for appropriate spring selection, to be based in part by dimensions of the spring chamber 30*b*, including an overall length of the spring chamber 30*b*, and an inner diameter of the insert 30. Hence, overall dimensions of the apparatus 100 are adjusted to the stock shape and style, and the spring 22 is selected by calculating the needed spring force, using standard recoil tables as in the example shown in FIG. 9, or by using known formulas for gun velocity and recoil in FIG. 10, along with dimensions of the spring chamber 30*b* (length and inside diameter).

The inventor is a former Navy Special Forces member and a competitive shooter who has used firearms his entire life. Recoil mitigation is important for shooting accuracy, to reduce time between shots fired, and for comfort, and he believes the prior art recoil mitigation devices that exist have largely failed to be widely implemented because of three critical design flaws: (1) they change the balance of the gun; (2) they are too expensive; and (3) they cannot be serviced easily. The prior art teaches a dazzling array of parts, multiple springs and moving mechanisms all nicely locked into the stock of the rifle. More parts mean more weight, and more weight change the balance of the gun. A balanced rifle weighs a same amount at its muzzle and its butt, with the balance point at a trigger area of the gun. The recoil mitigation device inside the stock thus must ideally not change the balance of the gun, which then requires the user to adapt, and is not ideal. The extra parts and complexity increase cost, and the inventor notes that there the prior art mitigation devices on the market are too expensive for the average user to fit onto every rifle owned, when multiple rifles would ideally be fitted with the recoil mitigation devices. Lastly, the inability of the user to service or otherwise adjust the prior art recoil mitigation devices is inconvenient and requires the user to try out many stocks, in Goldilocks fashion, to find the "right" one in terms of balance and then recoil mitigation. Since perceived recoil depends on physical characteristics of the user, including weight, height, stance when firing, etc., the only way to truly know if a stock is a "right" is to install it and then use it, which is not an easy option. Even in the "right" stock is found, springs wear out and the user must then return the stock to the manufacturer to service the internal components or throw away the stock and purchase a new one. Given the many variables with recoil, no two people will want the same level of recoil mitigation and thus a "one size fits all" recoil mitigation stock leaves many gun owners unhappy and hunting for the right amount of recoil mitigation and a comfortable stock.

In contrast, the apparatus 100 has a simple, durable and effective design that addresses the three problems in the prior art. First, the elegant design deliberately has the fewest parts that are designed to be strong but lightweight to prevent imbalance issues with the gun. Fewer parts mean less material cost and the specific design, using standard tubes and tube sizes, is done with an eye towards manufacturing simplicity, further reducing cost. Most importantly, the elegant design allows the user to easily service the spring with a simple hex key or screwdriver, and allow not only replacement of a worn spring, but also adjustment of recoil by substituting a spring with a larger or smaller spring force, as desired by the user. This adjustability feature is not found in the prior art and is unique to the inventor's apparatus 100. The single spring design is intentional and the inventor notes that the spring arrays in the prior art, while beautifully illustrated, are unnecessarily complex. The inventor's specific goal with his apparatus 100 is to make a simple, durable apparatus capable of easy adjustment and servicing by replacement of a single spring. He contends that his recoil mitigation apparatus 100, elegantly spartan in design, delivers superior and adjustable recoil mitigation that can be personalized to the individual shooter. The only "selection" factor for the user is the comfort of the stock against the shoulder 42, with stock balance now being fully adjustable via the removable spring 22.

The representative apparatus 100 tested by the inventor is made of steel, but other suitable materials include other metals such as aluminum and titanium, and other similarly strong, durable materials such as plastic and fiberglass and combinations thereof. The inventor's apparatus 100 is designed to be material-saving and easily manufactured so as to reduce cost.

Figure 6:
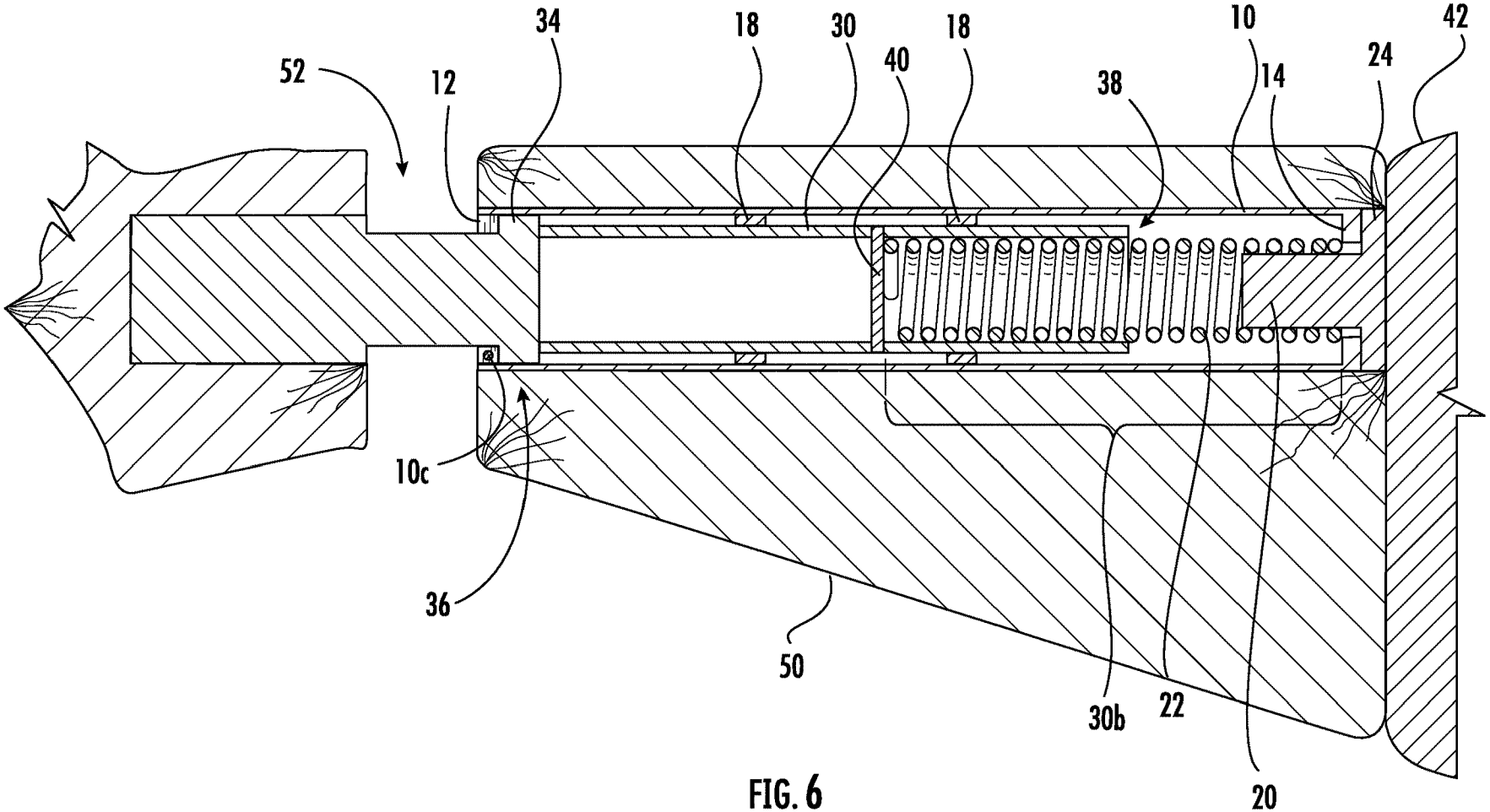
FIG. 6 is a side elevation, cross sectional view of the integrated recoil reduction apparatus as it would appear inside the stock, shown in a use position against a shoulder of the user and prior to firing a bullet.
Figure 7:
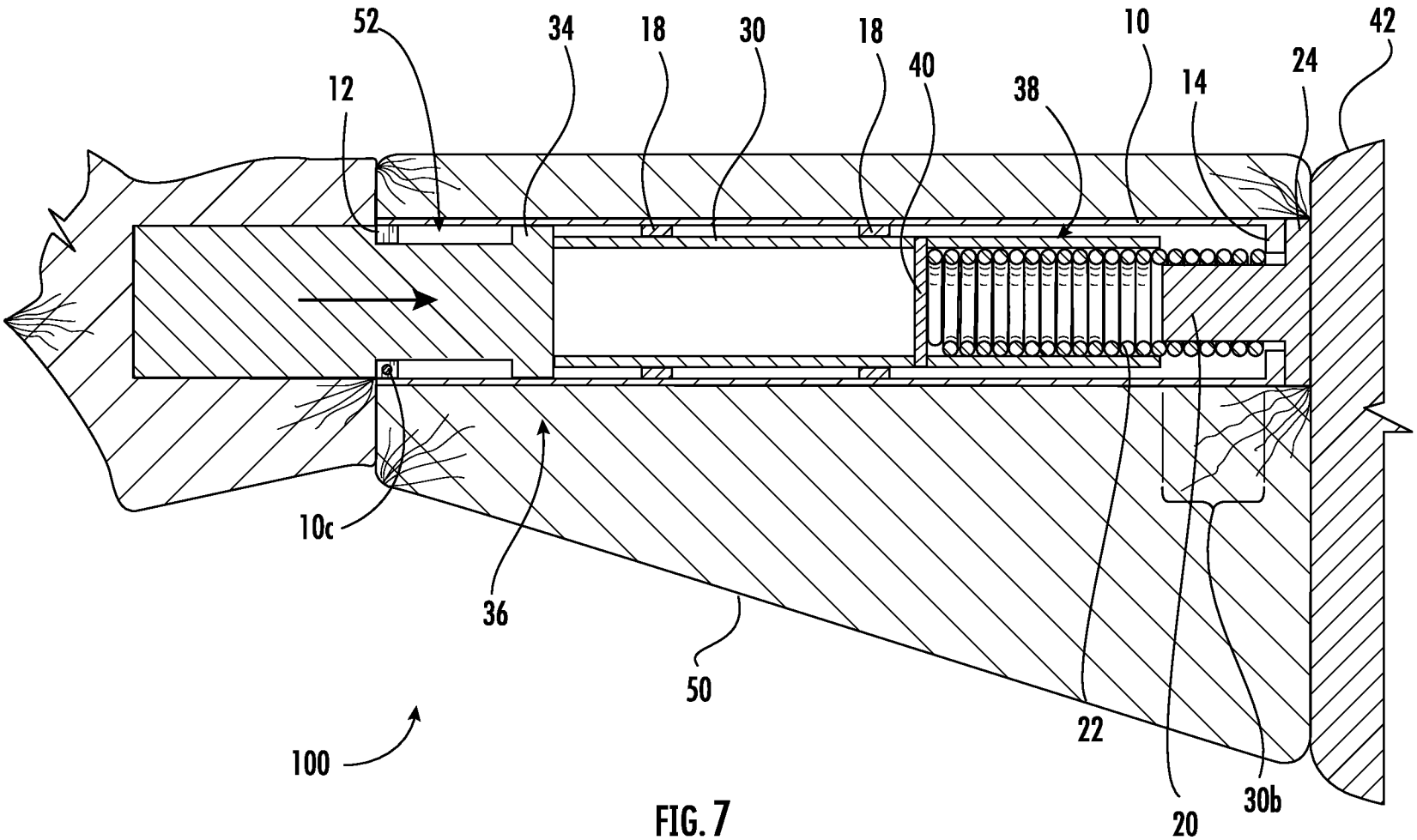
FIG. 7 is a side elevation, cross sectional view of the integrated recoil reduction apparatus in FIG. 6, shown after the bullet has been fired and showing recoil generated by firing the bullet transferring from the barrel to the apparatus inside the stock.
Figure 8:
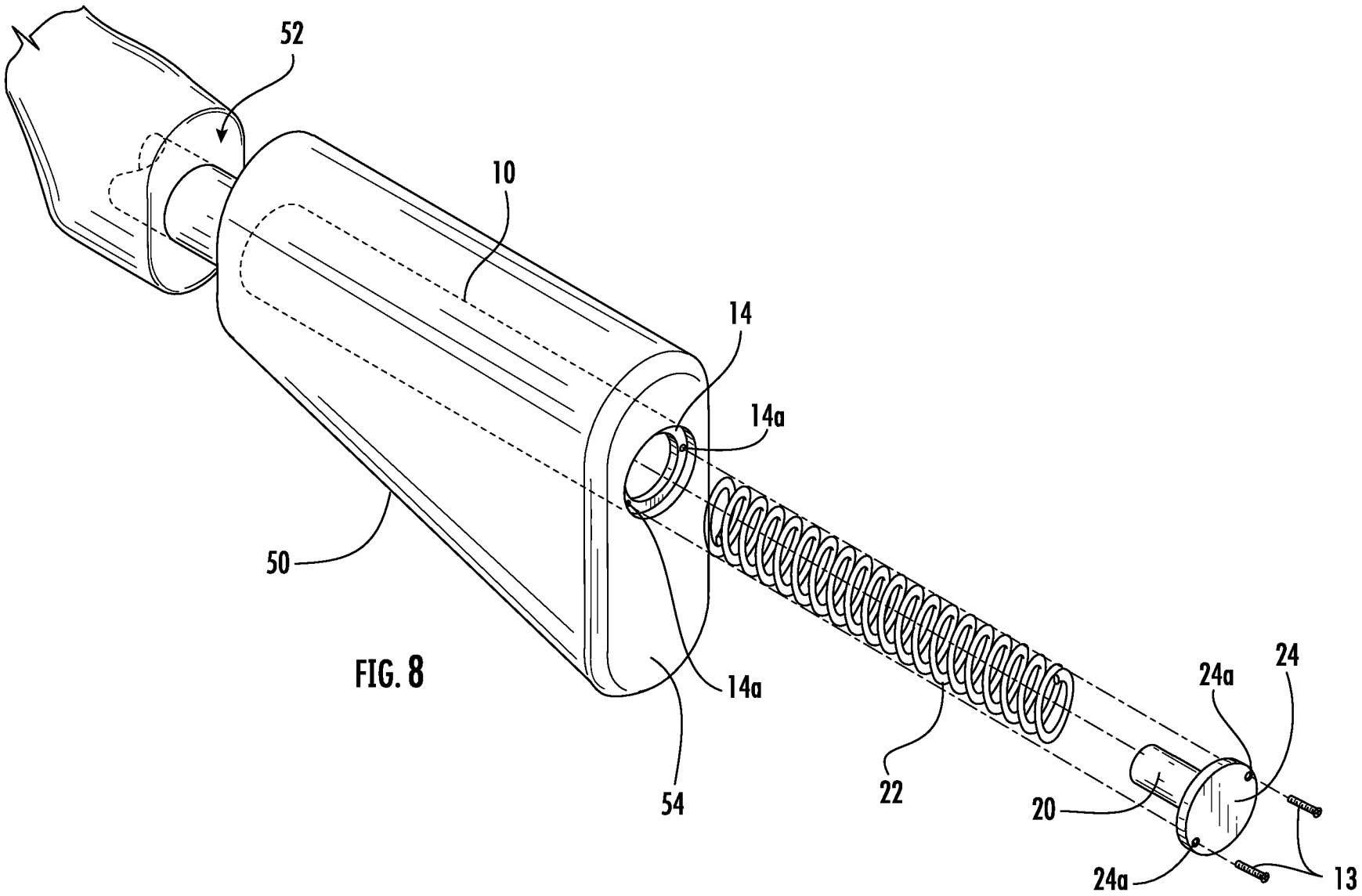
FIG. 8 is a partially exploded view of the integrated recoil apparatus as it would appear fitted inside the stock, showing the removal of the spring and end cap for spring replacement.

Turning now to FIG. 6, when a rifle fitted with the apparatus 100 is positioned in a use position, with the butt 54 of the stock firmly braced against the shoulder 42 of the user, firing a bullet creates energy that transfers from a base of the barrel where the explosive gases are created, to the apparatus 100. The entire rifle, including the sliding insert 30 and its distal end 38, slides towards the housing rear stop 14 of the housing 10 and towards the butt 54 of the stock (and ultimately, towards the user's shoulder 42). Energy transfers from the barrel base to the insert 30 and then to the spring 22, since movement of the insert 30 inside the housing chamber 10*a* forces the spring stop 40 against the spring 22, shortening or compressing the spring chamber 30*b* length and thus compressing the spring 22. The spring 22 absorbs and temporarily stores the energy, before releasing the energy by pushing against the spring stop 40, restoring the spring chamber 30*b* to its original size and pushing the insert 30 back to its original position, where the forward stop 12 of the housing 10 limits the forward movement of the insert 30 to its original resting position. The spring 22 thus absorbs all or a significant portion of the energy and thus reduces recoil at the user's shoulder 42, plus eliminates or minimizes muzzle lift at the opposed muzzle end of the rifle. The amount of recoil mitigation is influenced by the spring force, and the user has the option of adjusting the spring force by substituting springs with larger or smaller spring forces as desired. The ease with which the spring 22 can be removed and replaced is a distinct advantage of the apparatus 100 over any of the other designs currently in the prior art.

The apparatus 100 is easily integrated into a stock as it requires few parts and importantly does not significantly alter the weight, overall length, and appearance of standard OEM or replacement stocks available on the market, while decreasing recoil, muzzle lift, and time needed to reestablish aim before firing. The apparatus 100 integrated into a stock is thus an easy replacement for an existing stock, and requires little, if any time, for the user to adapt to use thereof. In fact, users who have never used recoil mitigation may especially appreciate the ability to adjust the spring since recoil perception is highly individualized and some users may actually prefer more "kick" than others.

The simplicity of the inventor's design is economical and has little impact on the weight of the stock, hence minimizing any change in the perceived feel of the firearm by the user while greatly improving firing comfort against the user's shoulder 42. Recoil mitigation leads to faster and more accurate shots, important in any situation where speed and accuracy are necessary when multiple shots are successively taken.

It is to be understood that the above-described arrangements are only illustrative of the application of the principles of the present invention. Numerous modifications and alternative arrangements may be devised by those skilled in the art without departing from the scope of the present invention. For instance, the Figures show the rail 32 as being formed on an exterior wall of the insert 30 in slideable, mating relationship with the slot 16 formed into the rib 18 of the housing chamber 10*a*, but notes that the slot 16 could be formed into a length of the exterior wall of the insert 30 and the rail 32 formed on the inside wall of the housing chamber 10*a*, that is, the reverse of the slot-rail mating structures disclosed in the Figures, without loss of functionality. Other mating or coupling systems that prevent rotation of the insert 30 within the housing 10 that does not otherwise hinder their telescoping, slideable relationship are useful embodiments of the slot-rail mating structures shown in the representative embodiment in the Figures and the inventor believes these other mating systems can be easily substituted without issue. The inventor stresses the elimination of material with his design, such as the rib-slot design, to ensure that the apparatus 100 does not alter the weight and feel of the stock, but acknowledges that a strong, lightweight material used for the apparatus 100 may make a longer guide rail and/or channel feasible without adding detrimental weight to the apparatus 100.

The inventor also notes that the partitioning of the insert chamber 30*a* by the spring stop 40 so as to create a spring chamber 30*b* as shown in the Figures may also be configured such that the insert chamber 30*a* and the spring chamber 30*b* are a same chamber, and the portion of the insert chamber 30*a* from the inner stop 34 to the spring stop 40 can in fact be solid i.e. not an empty space as is shown if the insert 30 is made of a lightweight but durable material such as plastic, as the extra material will have negligible effect on the weight of the apparatus 100. The inventor stresses that his apparatus 100 is an elegant solution using a single spring 22, greatly decreasing cost, weight and complexity of manufacturing and repair. The single spring, sized and shaped for the amount of recoil mitigation sought, will be of a larger spring force than a plurality of springs used in a single prior art reference for instance, and thus must be selected for durability, extending a useful life of the apparatus 100 and thus providing an extra benefit to the environment by minimizing waste or replacement. The inventor notes that in the recoil table provided in the Figures, weight of a spring needed to mitigate 15 foot pounds of recoil for a 30-06 Springfield rifle may be only 3-4 ounces lighter than a spring needed to mitigate 38 foot pounds of recoil for a .375 caliber rifle.

The inventor also notes that while his representative recoil mitigation apparatus shown in the Figures is directed at a rifle stock, there is no reason why it cannot be adapted to be used with any projectile-firing apparatus that is either hand-held, mobile, or mounted permanently in a way that repetitive recoil forces are detrimental to the mounting structures, for instance, or interfere with accurate aim and firing frequency.

What is claimed is:

1. A recoil mitigation apparatus for a rifle, comprising:

a housing tube having a housing wall with a first end and an opposed second end, and a continuous inner wall defining a housing chamber;

a forward stop at a first end of the housing chamber;

a rear stop at a second end of the housing chamber, the rear stop further comprised of a pair of apertures sized and shaped to receive a pair of screw fasteners;

a first rib formed along the inner wall of the housing chamber, with a first slot of a predetermined size and shape formed into the first rib;

an insert tube having an insert wall with a proximal end and a distal end, and a wall length spanning the proximal to distal ends, the insert wall further comprising a continuous exterior wall side and a continuous interior wall side, the interior wall side and the insert wall length defining an insert chamber;

an inner stop formed at a proximal end of the insert chamber;

a rail formed into a wall length of the exterior wall of the insert tube, the rail sized and shaped to slideably mate with the first slot;

a spring stop positioned inside the insert chamber partitioning the insert chamber into two parts;

a spring chamber having a proximal end and a distal end, with the spring stop positioned at a proximal end of the spring chamber inside the insert chamber and a housing rear stop at a distal end of the spring chamber inside the housing chamber;

a spring having a predetermined spring force, and having an uncompressed spring state and a compressed spring state, the spring positioned inside the spring chamber;

a removable end cap having a pair of screw holes adjacent the rear stop and aligned with the pair of apertures in the rear stop;

a spring mount attached to the end cap so as to be perpendicular thereto, the spring mount sized and shaped to receive the spring; and a pair of screw fasteners sized and shaped to removably secure into the pair of screw holes in the end cap and in the rear stop;

wherein the housing and insert are non-removably integrated into a stock of the rifle;

wherein the spring inside the spring chamber is removably accessible by removing the end cap from the housing;

wherein the insert chamber has a predetermined diameter, and the housing tube is sized and shaped such that the insert is in slideable, telescoping relationship with the housing chamber; and wherein the end cap is an outermost portion of the stock at a butt end of the stock.

2. The recoil mitigation apparatus in claim 1, wherein the insert chamber has a diameter, and wherein the spring stop is a pin positioned across the diameter of the insert chamber.

3. The recoil mitigation apparatus in claim 1, wherein the spring stop is a ring.

4. The recoil mitigation apparatus in claim 1, further comprising a second rib having a second slot formed therein, the second rib in spaced apart relationship with the first rib.

5. The recoil mitigation apparatus in claim 1, wherein the spring force of the spring is selected from the range consisting of about 2 to 40 foot pounds for an 8 pound rifle weight.

6. The recoil mitigation apparatus in claim 1, further comprising at least one housing screw, and wherein the forward stop is further formed with at least one forward stop hole and the housing tube is further formed with at least one housing hole, the hole of the housing tube and the at least one forward stop hole are sized and shaped to receive the housing screw.

7. The recoil mitigation apparatus in claim 1, wherein the end cap is a butt plate of the rifle.

8. A recoil mitigation apparatus for a rifle stock, comprising:

a pair of coaxial tubes, the pair comprised of an outer tube having a housing chamber wall and an inner tube having an exterior wall and an interior wall, the interior wall defining a spring chamber with a proximal end and a distal end, the exterior wall of the inner tube and the housing chamber wall of the outer tube in slideable, telescoping relationship with one another;

a rail formed into at least one of the housing chamber wall and the exterior wall of the inner tube, the rail oriented so as to be lengthwise along the housing chamber wall or the exterior wall of the inner tube;

a channel formed either into the housing chamber wall when the rail is formed into the exterior wall of the inner tube, or into the exterior wall of the inner tube if the rail is formed into the housing chamber wall, the channel sized and shaped to slidably mate with the rail;

a spring stop positioned at a proximal end of the spring chamber;

a housing rear stop positioned a distal end of the spring chamber, the spring stop and the housing rear stop defining a length of the spring chamber;

a spring of a predetermined uncompressed length, force and diameter removably housed inside the spring chamber;

wherein the spring chamber is at least a same length as the predetermined uncompressed length of the spring; and wherein the spring force is selected by calculating recoil energy in foot pounds based at least in part on a rifle weight and a caliber of bullet used by the rifle;

wherein the outer tube is further comprised of an end cap sized and shaped to removably cover the housing rear stop and wherein the end cap is accessible at a butt end of the stock; and wherein the end cap is further comprised of a spring mount centrally affixed to the end cap and sized and shaped to receive the spring.

9. The recoil mitigation apparatus for a rifle stock in claim 8, wherein the end cap and the housing rear stop are both further comprised of through holes and further comprising at least one fastener sized and shaped to fasten into the through holes, whereby the end cap is removably affixed to the housing rear stop.

* * * * *